United States Patent [19]

Wilfong

[11] 4,021,980

[45] May 10, 1977

[54] STORM WINDOW

[76] Inventor: Frank R. Wilfong, 5622 Lester Road, Cincinnati, Ohio 45213

[22] Filed: Aug. 8, 1975

[21] Appl. No.: 602,989

[52] U.S. Cl. ..... 52/202; 49/61; 40/152; 52/476

[51] Int. Cl.[2] ..... E06B 3/26

[58] Field of Search ..... 52/202, 476; 49/57, 49/61, 463, 466; 40/152

[56] References Cited

UNITED STATES PATENTS

| | | | |
|---|---|---|---|
| 2,191,500 | 2/1940 | Rosling | 52/202 |
| 2,414,183 | 1/1947 | Wolf | 40/152 |
| 2,572,764 | 10/1951 | Rogers et al. | 52/202 |
| 3,214,879 | 11/1965 | Ellingson | 52/202 |
| 3,783,543 | 1/1974 | Hemgren | 40/152 |

FOREIGN PATENTS OR APPLICATIONS

| | | | |
|---|---|---|---|
| 1,157,391 | 5/1958 | France | 52/202 |

*Primary Examiner*—J. Karl Bell
*Attorney, Agent, or Firm*—Irwin P. Garfinkle

[57] ABSTRACT

A storm window consisting of a rectangular window pane supported in a metallic frame is mounted over a window in a building by means of U-shaped channels mounted on the building and surrounding three sides of the building window. The storm window is slipped into channels and maintained in place by a friction or spring fit. The fourth side is closed by means of a U-shaped channel which is snapped or bonded onto the storm window frame.

6 Claims, 3 Drawing Figures

STORM WINDOW

BACKGROUND OF THE INVENTION

There are any number of storm window arrangements known to the prior art. These include the complex combination windows and screens which include tilt-out features for ventilation and cleaning. This type of window, while effective, and sometimes desirable, is very expensive, and often not economically warranted. That is, the cost and savings in fuel does not always justify the cost of the installation. As contrasted with the complex combination storm windows, a simple usually wooden frame storm window has been used. These generally are installed on pivots and secured in place by screws. Generally, these storm windows are not easily removed and require sealing each time they are reinstalled. The present invention is intended to provide an attractive, inexpensive, permanent and highly efficient storm window system in which the window is easily inserted and removed without tools and without the requirement for resealing.

SUMMARY OF THE INVENTION

The present invention provides a storm window which is mounted on the wall of the building to provide a sealed air space between the primary window and the storm window. The window consists of a glass pane supported by a conventional metal frame. The support for the storm window comprises a U-shaped channel which surrounds the primary window on three sides. The storm window is slid into the channel and is maintained in a sealed relationship to the channel walls by a friction or spring fit. The fourth side of the channel is a U-shaped channel member which is clipped or bonded to the storm window frame. Generally, the channels and the storm window frames are made of aluminum.

The present invention is an improvement over the known prior art in several respects. First, the present invention provides a very economical installation in terms of both labor and materials. Second, the present invention provides a storm window which is easily installed and removed as conditions warrant. Third, the installation is highly efficient in that the created air space created between the primary and storm windows is maximum in every case, and fourth, the installation is attractive for use on homes or factories.

Prior art background patents known to Applicant, but not regarded as anticipatory, include U.S. Pat. Nos. 3,328,929, 1,632,333, 1,730,781, 1,008,414 and 411,008. Most of these arrangements provide air spaces over the primary windows but do not have the simple, economical and efficient structure taught by this invention. U.S. Pat. No. 3,681,081 shows a structure which is somewhat similar in its appearance to Applicant's invention but it relates to a water barrier and it is open on one side and does not provide a sealed air space as required for storm window use.

THE DRAWINGS

DESCRIPTION OF THE ILLUSTRATED EMBODIMENTS

Figure 1:
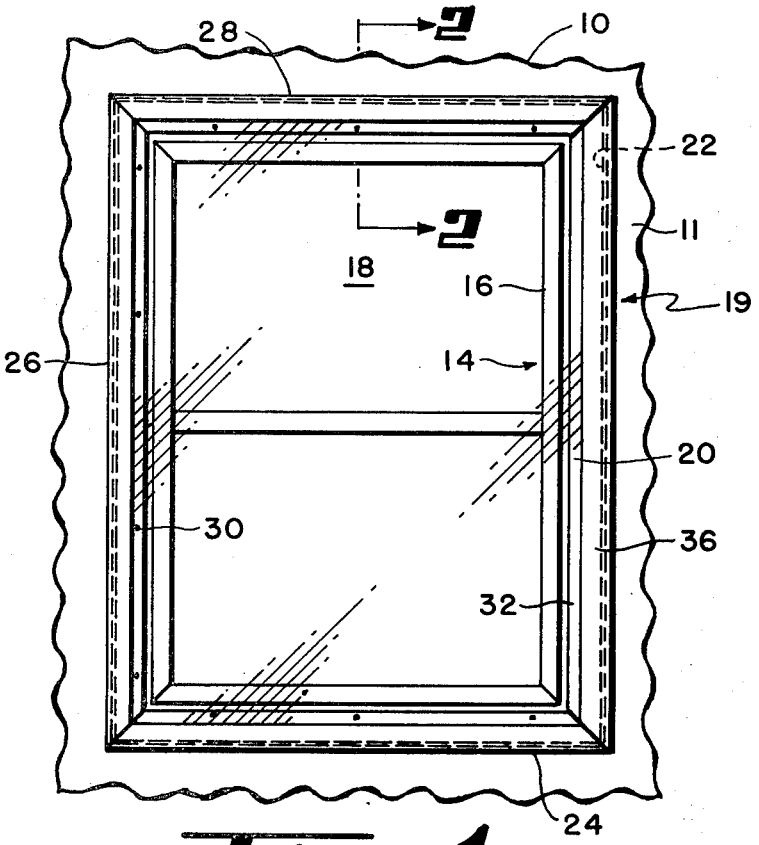
FIG. 1 is a view showing a storm window installed over a primary window of a building.
Figure 2:
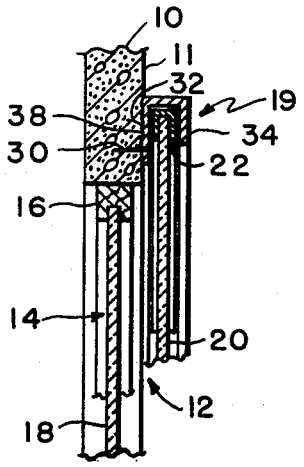
FIG. 2 is a cross section taken through the line 2—2 of FIG. 1.

FIGS. 1 and 2 show a building wall 10 having an exterior surface 11 and a rectangular opening 12 in which a conventional "primary" window 14 is installed. The primary window 14 may comprise a rectangular wooden frame 16 and several panes of glass 18. As shown, the window 14 is fixed, but in practice it may be made up of two or more slidable sections, or it may be of the metal casement type. As is conventional, the window 14 is set back from the exterior place surface 11 of the wall 10.

A storm window 19 for the primary window 14 comprises a rectangular window pane 20 supported at its four edges in an aluminum frame 22.

The mounting for the storm window 19 comprises three U-shaped channel members 24, 26 and 28 secured to the surface 11 of the wall 10 around the periphery of the opening 12. The U-shaped channels are sized in channel depth so as to provide a friction fit for the window frame 22. The lengths of the channels are also sized to closely fit the window frame 22 in height and width. As seen in FIG. 2, the channel members are secured to the surface 11 by nails 30 driven through the channel member side 32. It will be noted that the interior side 32 of the channel member is slightly larger than the opposite side 34. This is to facilitate installation. However, if the channels are bonded to the surface 11, or if special tooling is available, the dimensions of side 32 need not be larger than side 34. It will also be noted that the channels 24, 26 and 28 have been mitered so that they mate to provide a continuous channel on three sides of the window.

The fourth side of the support is closed by means of a fourth channel member 36. The member 36 is not secured to the surface 11 but is held on the exposed edge of the frame 22 by friction, or it may be secured by bonding. In either case it is preferable to mount the member 36 after the storm window has been inserted into the channels.

To provide a seal for the air space between the primary and storm windows it may be advantageous to use a caulking material 38 on the surface 11 under each of four channel members.

Figure 3:
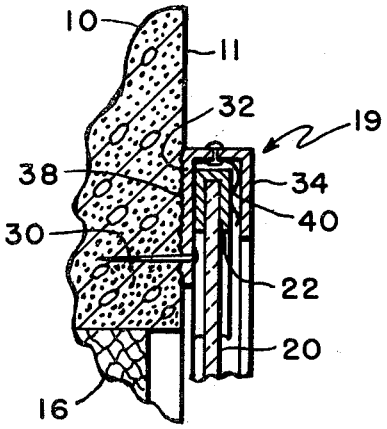
FIG. 3 is a modification showing the use of a leaf spring for sealing the storm window frame against the channel side.

As shown in FIG. 3, a seal between the frame 22 and the wall 32 of the channel members may be effected by means of leaf spring 40 positioned with the channels. This feature may be advantageous where the frames 22 are not standard sizes and a good friction fit is not made.

In practice, the arrangement is adaptable to a wide variation of window tolerances, since the channel members need not be an exact size, the only requirement being that they surround the primary window. Furthermore, the storm window may be made of a plurality of panes, not just one as shown. In addition, the fourth channel member may be secured with clips or by bonding to the surface 11.

I claim:

1. A storm window arrangement mountable on an external wall surface of a building over and spaced from a primary paned window recessedly mounted in an opening in the wall and set back from the external wall surface, said storm window arrangement being of multi-part construction, including a window pane, a multi-part mounting support for said window pane including three elongated channel shaped members securedly mounted on the external wall surface surrounding the periphery of the wall opening on three contiguous sides, and presenting a fixed three-sided frame having an inner, inwardly opening, continuous channel on said three sides, said frame having an open fourth side, said window pane being edgewise slidably insertable through said open side into, and supportable in and by, said continuous channel in a mounted position over and covering the wall opening and spaced therefrom, said window pane as mounted additionally covering and being spaced from and with respect to said primary paned window, said window pane being removable from said continuous channel, a fourth elongated channel shaped member similar to the first three said channel shaped members, said first three channel shaped members having a size and channel depth providing a friction fit for the window pane, with the lengths thereof being sized to closely fit the window pane in height and width, said fourth channel shaped member constituting a closure for the open fourth side and forming with the other three a continuous closed channel enclosing and supporting said window pane, said fourth member being removably mounted on and frictionally supported on and by the exposed edge of said window pane subsequent to placement thereof in the three-sided channel, sealing means between said channel members and said wall, and a friction seal between all said channel shaped members and said window pane.

2. The invention as defined in claim 1, wherein said sealing means between said channel members and said wall comprises a caulking compound.

3. The invention as defined in claim 1, wherein said friction seal between said channel shaped members and said window pane consists of a spring mounted on said members and operatively bearing against said window pane.

4. The invention as defined in claim 1, wherein the channel shaped members mounted on the external wall surface have one side wall thereof deeper than the opposite side wall, said members being secured to said wall surface by means of fasteners extending through said deeper side wall into said surface.

5. The invention as defined in claim 1, wherein said channel shaped members are bonded to said wall surface.

6. The invention as defined in claim 1, wherein a support frame surrounds and supports said window pane, said support frame being operatively insertable in said channel shaped members.

* * * * *